US010559157B2

(12) United States Patent
Treadwell et al.

(10) Patent No.: US 10,559,157 B2
(45) Date of Patent: Feb. 11, 2020

(54) AUTOMATED VENDING MACHINE WITH TRAY TRANSPORT SYSTEM

(71) Applicant: SIGNIFI SOLUTIONS INC., Mississauga (CA)

(72) Inventors: Simon Treadwell, Etobicoke (CA); Shamira Jaffer, Mississauga (CA)

(73) Assignee: SIGNIFI SOLUTIONS INC., Mississauga (CA)

( * ) Notice: Subject to any disclaimer, the term of this patent is extended or adjusted under 35 U.S.C. 154(b) by 146 days.

(21) Appl. No.: 15/764,357

(22) PCT Filed: Dec. 2, 2016

(86) PCT No.: PCT/IB2016/057330

§ 371 (c)(1),
(2) Date: Mar. 29, 2018

(87) PCT Pub. No.: WO2017/093975

PCT Pub. Date: Jun. 8, 2017

(65) Prior Publication Data

US 2019/0051088 A1 Feb. 14, 2019

Related U.S. Application Data

(60) Provisional application No. 62/263,208, filed on Dec. 4, 2015.

(51) Int. Cl.
*G07F 11/46* (2006.01)
*A47F 1/12* (2006.01)
(Continued)

(52) U.S. Cl.
CPC ..... *G07F 11/46* (2013.01); *A47F 1/12* (2013.01); *A47F 3/06* (2013.01); *A47F 3/14* (2013.01)

(58) Field of Classification Search
CPC ..... G07F 11/65; G07F 11/42; G07F 11/16; G07F 11/165; G07F 11/00; G07F 11/32; G07F 11/38
(Continued)

(56) References Cited

U.S. PATENT DOCUMENTS 6,230,930 B1 * 5/2001 Sorensen ..... G07F 11/16 221/131
6,267,522 B1 7/2001 Slippy et al.
(Continued)

OTHER PUBLICATIONS

Chitiu, Adrian, International Search Report, PCT International Application No. PCT/IB2016/057330 dated Jan. 23, 2017.
(Continued)

*Primary Examiner* — Gene O Crawford
*Assistant Examiner* — Ayodeji T Ojofeitimi
(74) *Attorney, Agent, or Firm* — Perry + Currier Inc.

(57) ABSTRACT

An automated vending machine for vending, accepting returns for, and restocking, vendible products. Vendible products are stored on moveable trays, resting on a shelving system, and are transported within the automated vending machine by a gantry system and dispensing unit. The shelving system and moveable trays can be adjusted to accommodate vendible products of varying shape, size, weight, and durability. The moveable trays are gravity fed forward into position for being coupled with the dispensing unit when selected. A supplementary storage area for restocking products and storing returned products is included.

20 Claims, 16 Drawing Sheets

(51) Int. Cl.
*A47F 3/06* (2006.01)
*A47F 3/14* (2006.01)

(58) Field of Classification Search
USPC ... 221/1, 133, 258, 123, 124, 233, 234, 220, 221/122
See application file for complete search history.

(56) References Cited

U.S. PATENT DOCUMENTS 6,513,677 B1* 2/2003 Sorensen ..... G07F 11/16 221/130
2001/0048000 A1* 12/2001 Arai ..... G07F 11/165 221/119
2003/0075552 A1* 4/2003 Ohkubo ..... G07F 11/58 221/131
2004/0090158 A1* 5/2004 Horowitz ..... A47F 1/12 312/319.4
2005/0189370 A1* 9/2005 Carter ..... G07F 11/165 221/123
2006/0208851 A1* 9/2006 Tsunoda ..... G07F 11/00 340/5.9
2006/0238082 A1* 10/2006 Heidemann ..... G07F 11/38 312/131
2006/0261080 A1* 11/2006 Matsumoto ..... G07F 11/58 221/124
2007/0021866 A1* 1/2007 Coppola ..... G07F 11/04 700/231
2007/0084876 A1* 4/2007 Ardern ..... G07F 11/16 221/258
2007/0108222 A1* 5/2007 Collins ..... G07F 11/165 221/251
2007/0221680 A1* 9/2007 Yuyama ..... G07F 11/165 221/124
2007/0241122 A1* 10/2007 Yuyama ..... G07F 11/165 221/56
2008/0061076 A1* 3/2008 Hieb ..... G07F 11/165 221/220
2008/0083769 A1* 4/2008 Yuyama ..... G06Q 50/22 221/1
2008/0099496 A1* 5/2008 Black ..... G07F 9/026 221/13
2008/0135574 A1* 6/2008 Hieb ..... G07F 11/10 221/123
2008/0179343 A1* 7/2008 Perkins ..... G07F 11/00 221/208
2009/0076650 A1* 3/2009 Faes ..... G07F 11/165 700/232
2009/0277853 A1* 11/2009 Bauer ..... A47F 1/087 211/59.3
2010/0243666 A1* 9/2010 Skavnak ..... G07F 11/165 221/1
2011/0054673 A1* 3/2011 Segal ..... G07F 11/00 700/230
2011/0226795 A1* 9/2011 Sichich ..... G07F 11/165 221/1
2012/0078412 A1* 3/2012 Mockus ..... G07F 9/026 700/230
2012/0277904 A1* 11/2012 Pritchard ..... G07F 9/02 700/232
2013/0341344 A1* 12/2013 Abston ..... G07F 9/105 221/150 R
2014/0124527 A1* 5/2014 Quiring ..... G07F 11/14 221/150 R
2015/0206373 A1* 7/2015 Kim ..... G07F 9/10 221/1
2015/0230658 A1 8/2015 De Luca et al.
2018/0174392 A1* 6/2018 Jafa ..... G07F 11/005
2019/0088068 A1* 3/2019 Fan ..... G07F 11/42

OTHER PUBLICATIONS

Chitiu, Adrian, Written Opinion, PCT International Application No. PCT/IB2016/057330 dated Jan. 23, 2017.

* cited by examiner

AUTOMATED VENDING MACHINE WITH TRAY TRANSPORT SYSTEM

FIELD OF THE INVENTION

The present invention is in the technical field of automated vending machines.

BACKGROUND OF THE INVENTION

In the past, most automated vending machines, also known as automated retail kiosks, were used for dispensing beverage cans, bottles, snacks, or other small durable products. More recently, there has been a demand for developing automated vending machines which can dispense products of varying size, ranging from large boxed products to small or thin gift cards or personal accessories, and which can dispense delicate objects, such as electronics.

One of the problems associated with conventional automated vending machines, and with recently developed machines, is the difficulty associated with handling products that may vary in various respects such as size, shape and weight. Existing automated vending machines, for example, have difficulty securely dispensing both small accessories, such as jewelry, and heavier sensitive products, such as laptops, within the same system. Attempts at mechanizing the shelving system in an automated vending machine entails additional moving parts, and thus entails frequent maintenance concerns. Even still, existing automated vending machines lack the ability to display products upright as they would appear in a retail store, accept product returns, and restock products in the way that can be done at a retail store.

SUMMARY OF THE INVENTION

In the following specification, the automated vending machine described herein generally comprises a moveable tray. In some instances, the tray can be used for vending a product, returning a product, or restocking a product in the automated vending machine. Hence, the tray can be referred to as a "moveable tray", "vending tray", "return tray", or "restocking tray", as the case may be. However, it is generally appreciated that the term "tray" can refer to the moveable tray performing any of these functions, as will be appreciated in the relevant context.

According to an aspect of the specification, an automated vending machine is provided. The automated vending machine includes a housing defining an interior, the interior having a dispensing zone accessible from an exterior of the automated vending machine, a shelving system having wall racking, support shelves, and declined rails, each support shelf of the support shelves and the wall racking configured with hook coupling mechanisms for facilitating manual releasable coupling of the support shelf to the wall racking, the wall racking for receiving and supporting each support shelf of the support shelves at desired heights, each support shelf of the support shelves supporting a declined rail of the declined rails having a declivity from an upper end of the declined rail to a lower end of the declined rail and a stopper at the lower end. The automated vending machine includes a plurality of moveable trays disposed within the interior of the housing, each of the plurality of moveable trays riding on a respective declined rail of the declined rails, whereby each respective moveable tray is gravity fed toward the stopper at the lower end of the respective declined rail, each moveable tray of the plurality of moveable trays configured to support a vendible product displayed thereon. The automated vending machine includes a dispensing unit having a coupling mechanism configured to releasably couple with a moveable tray, and a gantry system configured to move the dispensing unit about the interior of the automated vending machine and the dispensing zone, and configured to position the coupling mechanism of the dispensing unit for releasably coupling and decoupling with a moveable tray.

In some embodiments, the lower end of a declined rail extends in a protruding portion beyond a respective support shelf supporting the declined rail, and the protruding portion of the declined rail defines a cutout for receiving the coupling mechanism of the dispensing unit from below the declined rail for raising a moveable tray off the declined rail.

In some embodiments, the interior of the automated vending machine includes a supplementary storage shelving system for storing restocking products, each restocking product being supported on a moveable tray.

In some embodiments, the coupling mechanism of the dispensing unit includes a coupling magnet for releasably coupling with a magnetic portion of a moveable tray.

In some embodiments, the coupling magnet of the coupling mechanism comprises an electromagnet.

In some embodiments, a moveable tray supporting a vendible product further includes a retaining magnet for magnetically coupling with a magnetic portion of the vendible product.

In some embodiments, the dispensing unit is configured to retract a coupled moveable tray over a support stage of the dispensing unit.

In some embodiments, at least one of the declined rails comprises a pair of complimentary declined rails suitable for conforming to a base of a moveable tray by being spaced apart on a support shelf.

According to another aspect of the specification, a moveable tray for carrying a vendible product in an automated vending machine is provided. The moveable tray includes a base configured to be in slidable communication with a declined rail in the automated vending machine, the base having an attachable portion for receiving a coupling mechanism of a dispensing unit of the automated vending machine, and a detachable stand slotted into a slot in the base of the moveable tray at a juncture, the slot allowing slidable movement of the detachable stand across a length of the base, the juncture supporting the detachable stand at an inclined angle for supporting a vendible product leaning upright against the detachable stand.

In some embodiments, the coupling mechanism of the dispensing unit comprises a coupling magnet, and the attachable portion of the base comprises a magnetic portion for coupling with the coupling magnet.

In some embodiments, at least one of the base and the detachable stand further comprise a magnet for magnetically coupling with a magnetic portion of the vendible product.

According to yet another aspect of the specification, a method of operating an automated vending machine is provided. The method includes receiving a movement request indicating a first location and a second location, the first location being occupied by a moveable tray, the second location being a destination suitable for being occupied by the moveable tray, sending a command to a gantry system indicating the first location and the second location, using the gantry system to move a dispensing unit into a position near the first location for coupling with the moveable tray, coupling the dispensing unit with the moveable tray, using the gantry system to move the dispensing unit with the moveable tray into a position near the second location for decoupling with the moveable tray at the second location, and decoupling the dispensing unit from the moveable tray.

In some embodiments, the movement request is a vending request, the moveable tray is carrying a vendible product for being vended, the first location is at a support shelf in a display area of the automated vending machine, and the second location is at a dispensing zone accessible from an exterior of the automated vending machine.

In some embodiments, the movement request is a restocking request, the moveable tray is carrying a vendible product for being restocked, the first location is at a support shelf in a supplementary storage area of the automated vending machine, and the second location is at a support shelf in a display area of the automated vending machine.

In some embodiments, the movement request is a product return request, the moveable tray is an empty moveable tray suitable for receiving a product being returned, the first location is at a support shelf in the automated vending machine for storing empty moveable trays, the second location is at a dispensing zone accessible from an exterior of the automated vending machine, and the method further comprises, prior to the decoupling step, receiving a product being returned on the moveable tray, and using the gantry system to move the dispensing unit with the moveable tray into a position near a third location for decoupling with the moveable tray at the third location, the third location being at a support shelf in a supplementary storage area of the automated vending machine.

In some embodiments, the movement request is a product return request, the moveable tray is an empty moveable tray suitable for receiving a product being returned, the first location is at a support shelf in the automated vending machine for storing empty moveable trays, the second location is at a dispensing zone accessible from an exterior of the automated vending machine, and the method further comprises, prior to the decoupling step, receiving a product being returned on the moveable tray, and using the gantry system to move the dispensing unit with the moveable tray into a position near a third location for decoupling with the moveable tray at the third location, the third location being at a support shelf in a display area of the automated vending machine.

In some embodiments, following the receiving step, it is verified that the product being returned has been received on the moveable tray.

In some embodiments, the coupling step includes positioning a coupling mechanism of the dispensing unit below an attachable portion of a base of the moveable tray, and raising the coupling mechanism to couple with the attachable portion of the base of the moveable tray.

In some embodiments, the coupling mechanism of the dispensing unit comprises a coupling magnet, and wherein the attachable portion of the base of the moveable tray comprises a magnetic portion for coupling with the coupling magnet.

Other features and advantages of the present invention are described more fully below.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

The present invention relates to an automated vending machine, also known as an automated retail kiosk, which can automatically vend products, accept returns of products, and restock products, using moveable trays and a gantry system with a dispensing unit for moving the trays.

The automated vending machine includes a modular shelving system that can be adjusted for allowing trays with products of varying sizes to be displayed with minimal labor required to adjust the shelving. The automated vending machine can thereby display products of varying shape, size, weight, and durability. For example, the automated vending machine can stock and deliver stamps, collectable coins, stationary, gift cards, luxury personal accessories, over-the-counter drugs, packaged foods, electronic devices such as smartphones and laptop computers, toys, parcels, and other items.

The moveable trays rest on rails supported by support shelves. The rails are declined toward the front of the automated vending machine, thereby allowing the moveable trays to be gravity fed by the rails toward the front of the automated vending machine. The declined rails and the moveable trays riding thereon obviate the need for motors, wiring, and moving parts for bringing products forward, and such associated costs and maintenance concerns.

The gantry system can lift a moveable tray off the shelving system and deliver the moveable tray, with its product, to a dispensing zone for a customer to retrieve. The gantry system can also move trays about the interior of the automated vending machine for other reasons. For example, the gantry system can move an empty tray, after having just vended a product, to a tray disposal area. The gantry system can also retrieve an additional supply of vendible products from a supplementary storage shelf and move a vendible product to the main product display area for restocking purposes. The gantry system can also bring an empty tray into the dispensing zone for receiving a product being returned by a customer, and can then store the returned product in, for example, the supplementary storage area. The gantry system can be controlled via input commands made by a customer through a user interface of the automated vending machine, such as when vending a product, or can be controlled via a networked (cloud) computing system, such as when restocking a product.

The automated vending machine can include dynamic lighting for lighting the product display area, advertising screens, messages, and sounds, for drawing a customer's attention, and an interactive user interface device for providing an aesthetic and engaging user experience.

Figure 1:
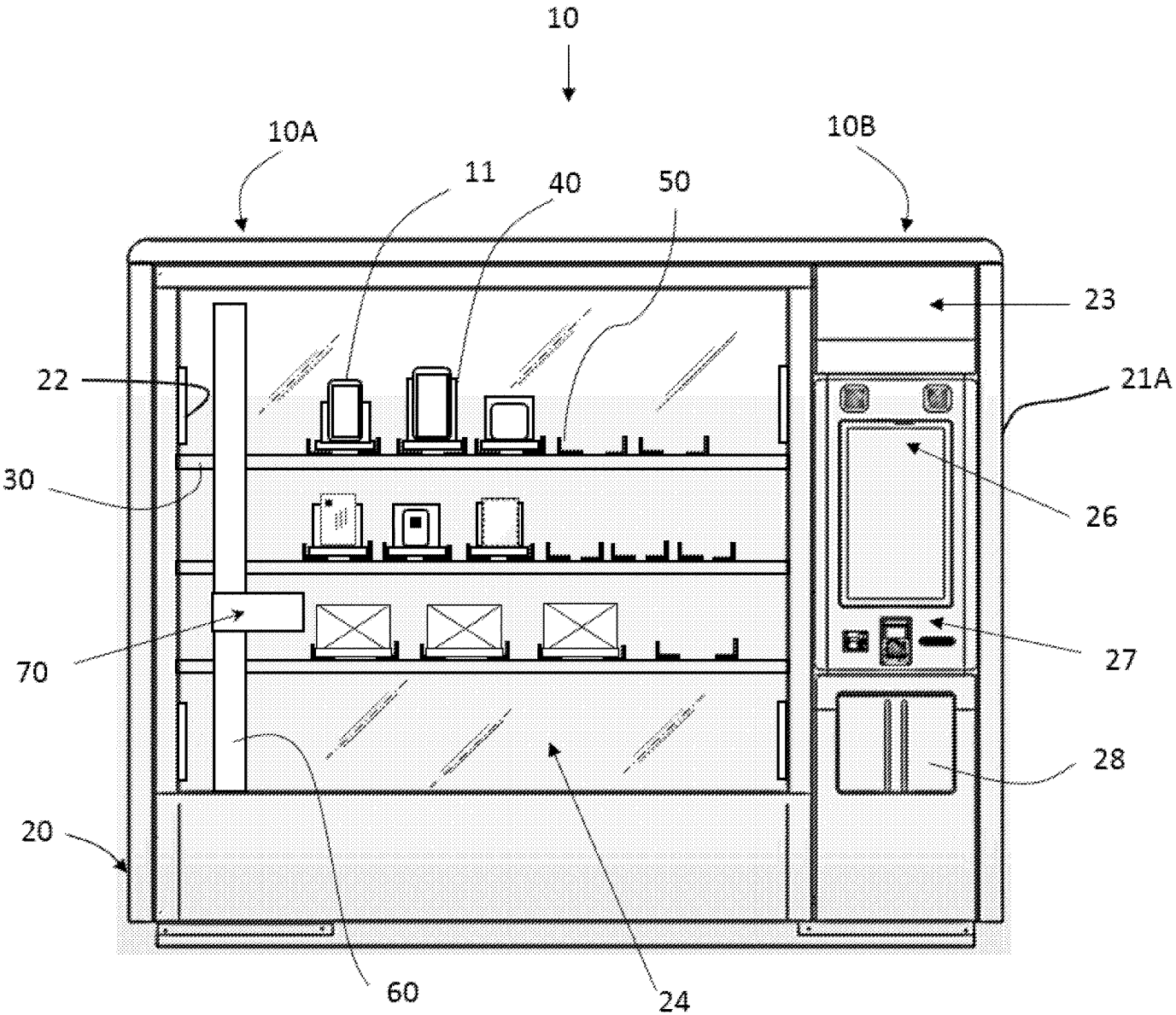
FIG. 1 is a front view of an automated vending machine.
Figure 2:
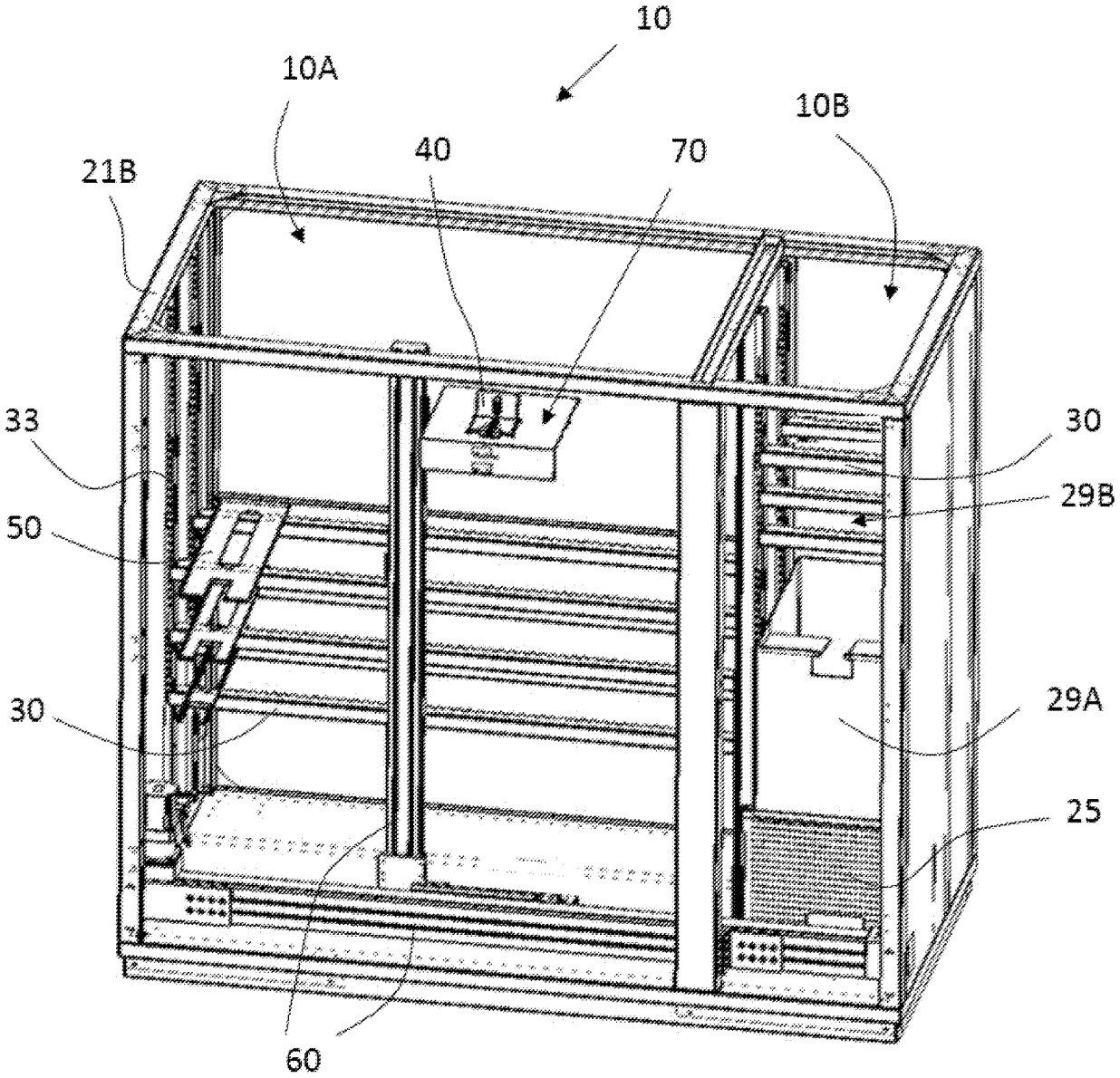
FIG. 2 is a perspective view of the automated vending machine with the housing omitted to reveal an interior of the automated vending machine.

Referring to FIGS. 1-2, an automated vending machine is indicated generally at 10. The automated vending machine 10 includes a housing 20, which houses a main product display area 10A and a control area 10B. The housing 20 includes walls 21A and frame 21B for supporting the housing 20.

The main product display area 10A includes support shelves 30, which support rails 50. The moveable trays 40 ride on the rails 50 and carry and display vendible products 11. The main product display area 10A is visible through a viewing window 24 at the front of the automated vending machine 10, and is lit by lighting fixtures 22.

The automated vending machine 10 also includes a gantry system 60 which can position a dispensing unit 70 about the main product display area 10A and the control area 10B.

In some embodiments, the housing 20 can contain thermal insulation to maintain a relatively constant temperature inside the automated vending machine 10. For example, the walls 21A can include materials like polyurethane form or expanded polystyrene or the like. The viewing window 24 can also include multi-layered glass to provide thermal insulation and to inhibit condensation.

In some embodiments, the frame 21B can include additional supports for displaying advertisement screens, posters, or the like, within the main product display area 10A. Similarly, the walls 21A can include additional supports for such signage on the exterior of the automated vending machine 10. The main product display area 10A can also contain additional display means for enhancing the customer's experience and aesthetics. For example, the display means can comprise showcases with product samples, images from electronic devices like liquid crystal displays (LCDs), organic light-emitting diodes (OLEDs), or projectors, and dynamic lighting fixtures.

The control area 10B includes control system 25 for controlling the gantry system 60, and includes a user interface device 26 such as an electronic display for enabling a customer to initiate the vending and returning processes, described in greater detail below. The control area 10B further comprises a payment module 27 for facilitating such transactions. In some embodiments, the user interface device 26 and the payment module 27 may be combined or separated as would be readily apparent to the person skilled in the art.

The control system 25 includes a computing system having one or more processors, memory, and communication devices for facilitating its operation and for interfacing with other components of the automated vending machine 10. The term "processor" as discussed herein refers to any quantity and combination of a processor, a central processing units (CPU), a microprocessor, a microcontroller, a field-programmable gate array (FPGA), and similar. The memory of the control system 25 can comprise volatile storage, non-volatile storage, or a combination, such as random-access memory (RAM), read-only memory (ROM), flash memory, optical storage, magnetic storage, and similar.

The control system 25 can communicate with the gantry system 60 and the user interface device 26 and payment module 27 for executing the methods for vending, returning, and restocking, as discussed in greater detail below. In some embodiments, the control system 25 can communicate with external systems, such as network (cloud) systems, over one or more computer networks, which can include the internet, a Wi-Fi network, a local-area network, a wide-area network (WAN), a virtual private network (VPN), a combination of such, and similar. For example, in some embodiments, the control system 25 is configured to alert an external system that it is low on stock of a given product, and request that additional stock be added to its supplementary storage shelving.

The control area 10B further comprises a dispensing zone 28 from which a vended product can be retrieved by a customer. The dispensing zone 28 can also be the site where products to be returned are placed. The control area 10B further comprises supplementary storage area 29B, with additional support shelving 30, for storing additional stock for restocking, or for storing returned products. The control area 10B further comprises a used tray bin 29A for temporarily storing unused empty trays. The supplementary storage area is accessible through an access door 23.

The control area 10B further comprises speakers for conveying auditory information, sounds, and music, and can include microphones for recording user instructions, a camera for observing a dispensing zone 28, and a camera for observing a customer.

For the safety of operators or customers, in some embodiments, the automated vending machine 10 can include safety sensors attached to the access door 23, dispensing zone 28, or other appropriate places, which can signal the control systems 25 to halt operations of the automated vending machine 10. For example, when an operator opens the access door 23, the gantry system 60 can be instructed to stop moving.

Figure 3:
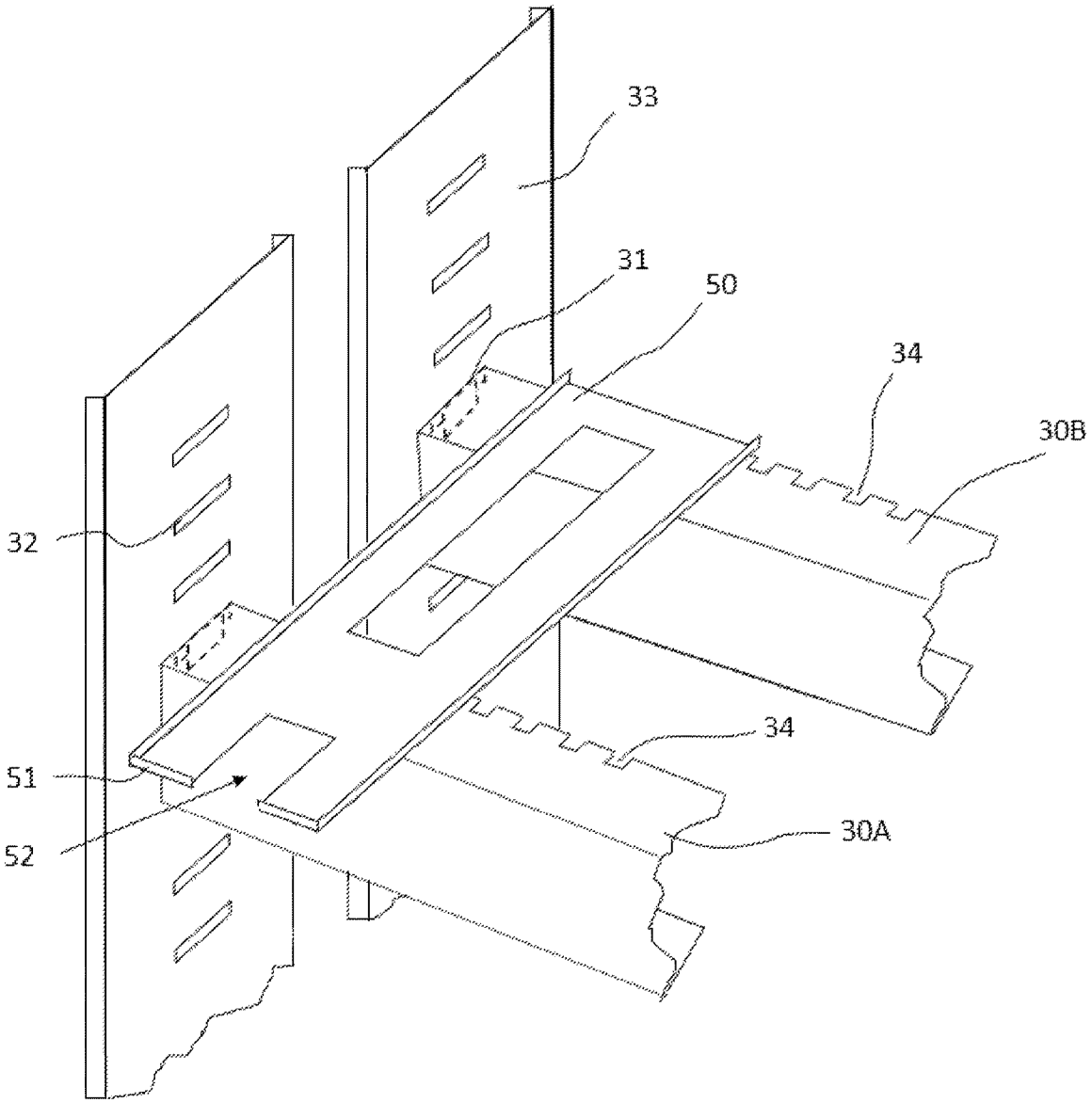
FIG. 3 is a partial perspective view of a shelving system of the automated vending machine.

Referring now to FIG. 3, the shelving system is described in greater detail. The shelving system comprises a wall rack 33, a support shelf 30, and a rail 50 for supporting a moveable tray 40. Each support shelf 30 comprises a front support shelf 30A and a rear support shelf 30B, with the front support shelf 30A being situated nearer to the viewing window 24.

Each front and rear support shelf 30A, 30B comprises a hook coupling mechanism for releasably coupling with the wall rack 33. In the present embodiment, each support shelf 30A, 30B comprises a tongue 31, and the wall rack 33 comprises slots 32 for engaging in a tongue-and-slot connection. In other embodiments, the wall rack 33 may comprise tongues, and each support shelf 30A, 30B may comprise a slot. Other mechanical connections that allow for manual assembly and disassembly are contemplated.

In the present embodiment, wall rack 33 comprises several slots 32 along its length, allowing each front support shelf 30A and rear support shelf 30B to be independently supported at various heights. The vertical spacing between each of the several support shelves 30A, 30B can therefore be extended by placing the shelves farther apart to provide the required space for carrying and displaying a variety of products 11.

In some embodiments, the slots 32 can have symbols or numbers (not shown) to identify the height level of the support shelf 30. In some embodiments, a support shelf 30A, 30B can also have an embedded leveler tool (e.g. a bubble level) for easily determining its slope.

To support a rail 50, a front support shelf 30A is slotted into the wall rack 33 at a certain height, and a rear support shelf 30B is slotted into the wall rack 33 at a greater height. The support shelf 30, and the rail 50 situated thereon, are thus declined toward the front of the automated vending machine 10. The moveable trays 40, situated on rails 50, are thereby gravity fed forward toward the viewing window 24. The front end of each rail 50 includes a stopper 51 which prevents the moveable tray 40 from sliding further off the rail 50. Thus, in operation, when one moveable tray 40 is removed from a shelf 30, another moveable tray can take its place without the use of any moving parts or motors.

Each rail 50 has a hook structure underneath it for hooking securely with the shelf 30 by mating with the notches 34, which securely hold each rail 50 in place. A variety of mechanical connections between the rail 50 and the shelf 30 is contemplated.

The front portion of the rail 50 extends forward from the front shelf 30A and features a cutout 52 at its lower front end. The front-most moveable tray 40 on the rail 50 therefore rests on the on the rail 50 with an open space underneath. This cutout 52 provides space for the dispensing unit 70 to couple with and lift the moveable tray 40, as described in greater detail below.

The width of each rail 50 can vary depending on the required width of each moveable tray 40, as required by the size of the vendible product 11. For larger moveable trays 40, the depth of the cutout 52 in the front portion of the rail 50, from the front end of the rail 50 toward the front shelf 30A (in the Z direction of FIG. 8), can be larger so that the cutout 52 extends generally under the centre of the moveable tray 40. In a preferred embodiment, the depth of the cutout 52 is greater than half the depth of the moveable tray 40.

Figure 4:
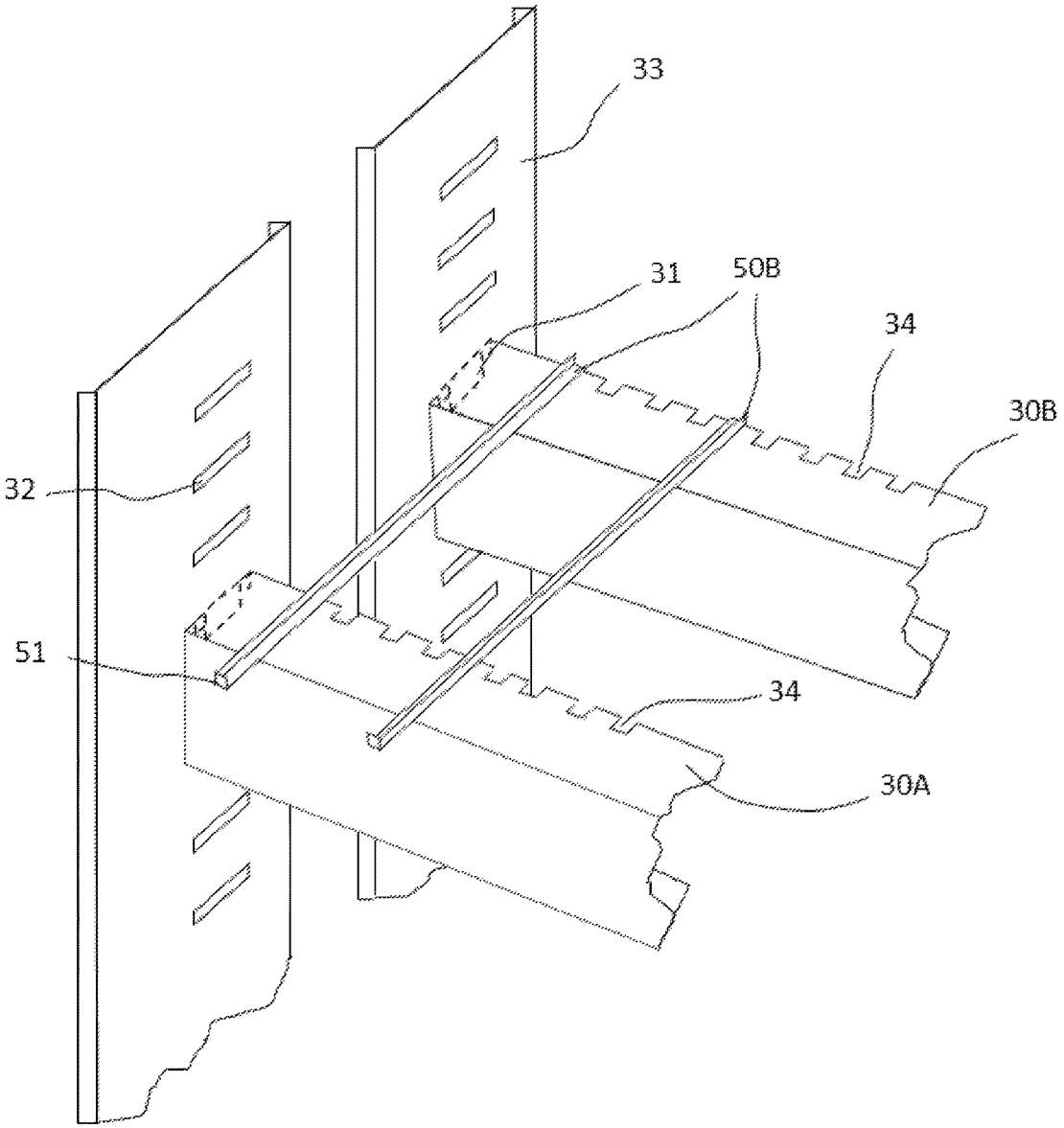
FIG. 4 is a partial perspective view of an alternative shelving system of the automated vending machine.

FIG. 4 shows another embodiment in which the rail 50 is substituted for a pair of complementary rails 50B. The pair of complementary rails 50B is, as above, situated across a front shelf 30A and a rear shelf 30B, and can mate with notches 34. The pair of complementary rails 50B also extends further than the front shelf 30A, leaving an open space underneath each moveable tray 40. The distance between each of the complimentary rails can be readily adjusted to accommodate the width of the moveable tray 40 holding the vendible product 11. Each rail in the pair of complementary rails 50B has an L-shaped cross section at each side and has a stopper 51 at the front end which prevents a moveable tray 40 riding thereon from sliding further off the support shelf 30.

In the present embodiment, each support shelf 30A, 30B is made of steel, and is of a C-shaped cross section to distribute the load acting it, and has notches 34 to mate with rails 50.

Figure 5:
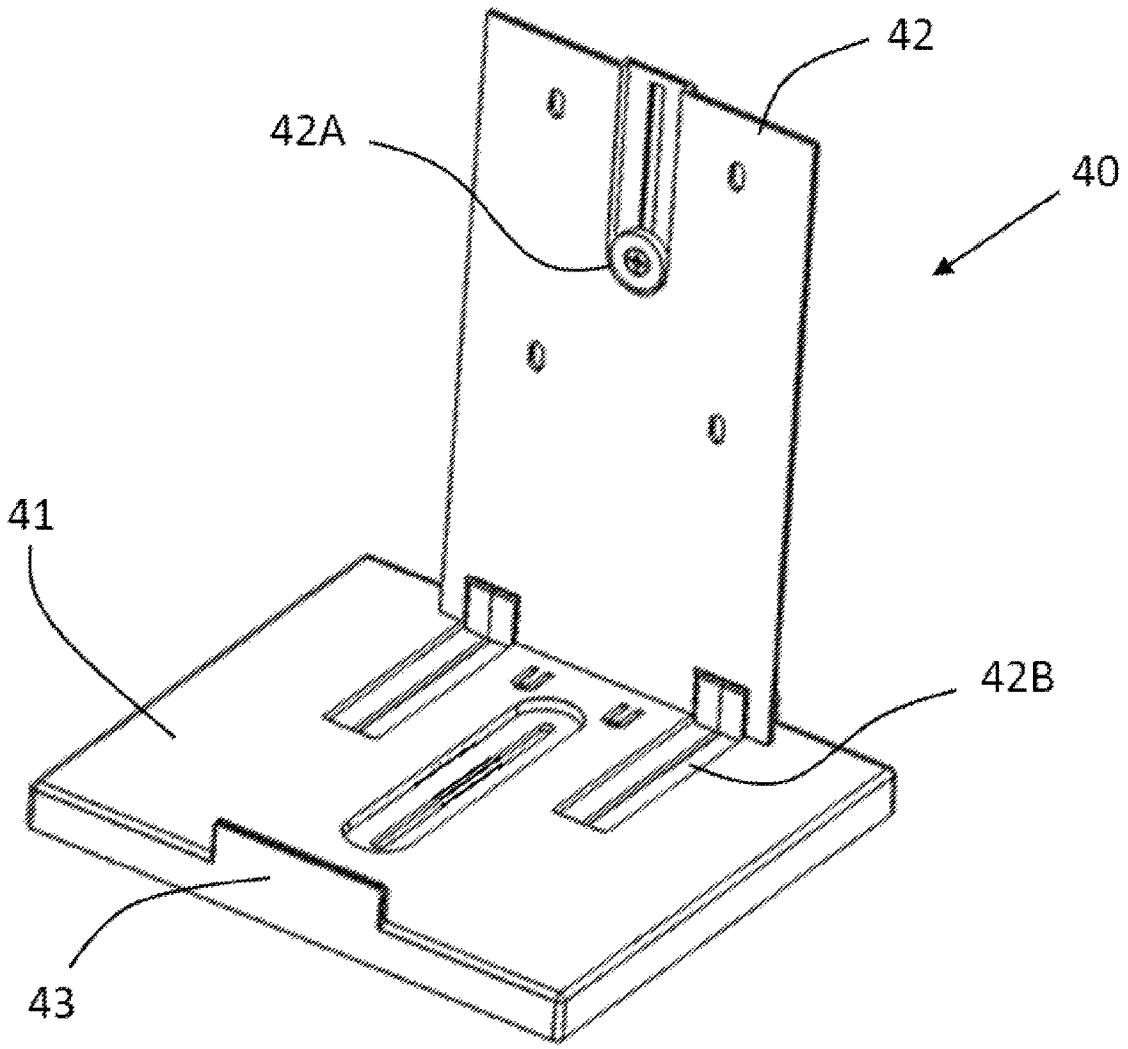
FIG. 5 is a perspective view of a moveable tray of the automated vending machine.
Figure 6:
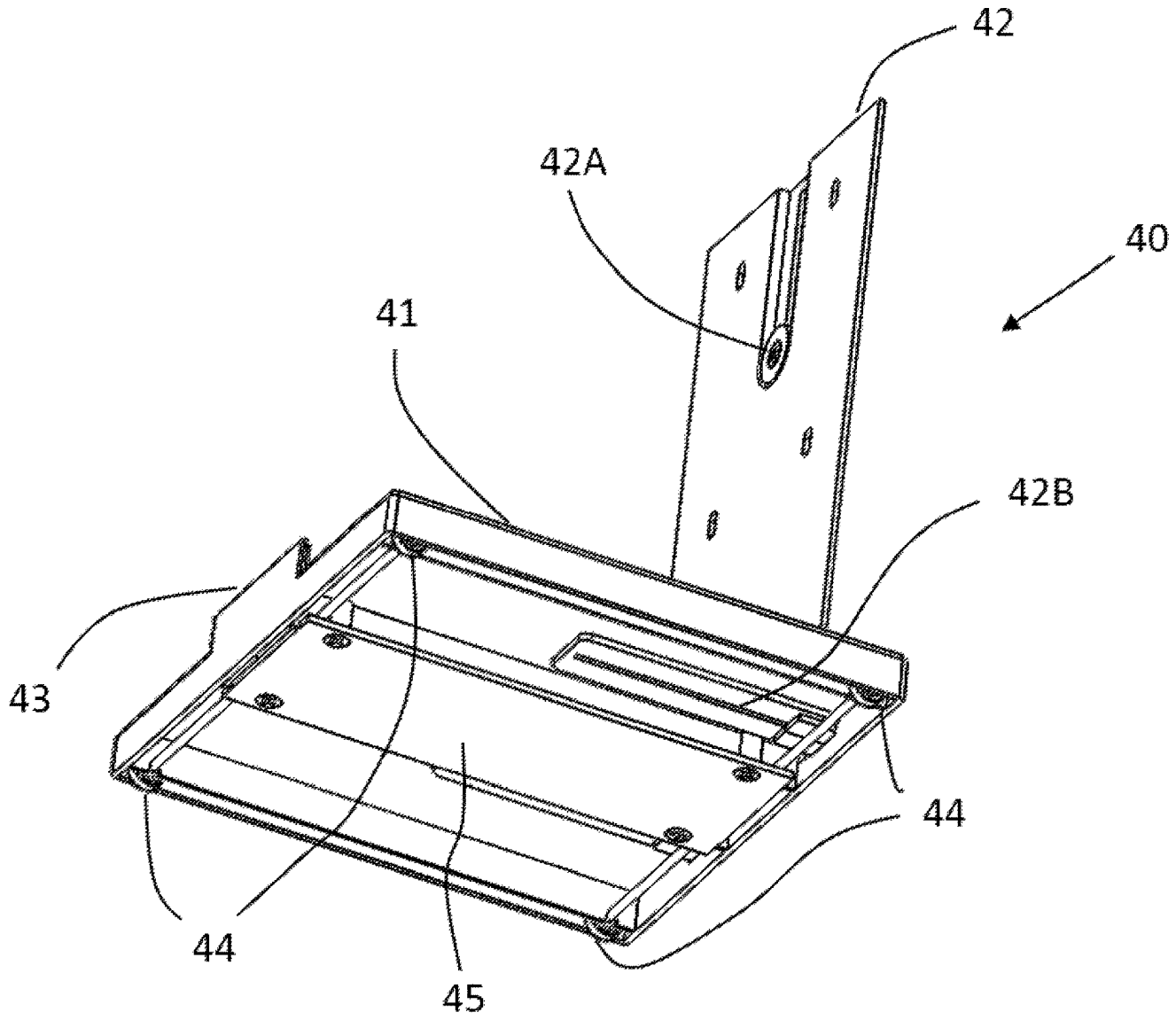
FIG. 6 is a perspective view of the moveable tray as viewed from below.

Referring now to FIGS. 5-6, a moveable tray 40 is described in greater detail. The moveable tray 40 comprises a base 41 and a stand 42. The stand 42 is slotted into the base 41 near the rear end of the base 41. The stand 42 extends upwards at an angle conducive to supporting and displaying a product. In some embodiments, a vendible product 11 can be stood up against the stand 42 to allow the vendible product 11 to be displayed upright, as it would appear in a retail store.

The moveable tray 40 can have a retaining element to hold the product 11 securely. The retaining element can be an adhesive material or a magnet which can magnetically couple to a magnet or magnetic substance attached to a vendible product 11. In the present embodiment, the retaining element is a retaining magnet 42A, such as a permanent magnet. The retaining magnet 42A can magnetically couple with a magnetic portion of the vendible product 11 or its packaging, such as a magnetic sticker, to securely and releasably hold the vendible product 11 in place. The retaining magnet 42A is slidably attached to the stand 42 so that the position of the retaining magnet 42A can be adjusted to couple with the magnetic portion of the vendible product 11. These retaining magnets 42A can comprise neodymium magnets, flexible magnets, or other types of magnets depending on shapes, magnetic strengths, environments and costs.

The moveable tray 40 is movable along the rail 50 by moving elements between the rail 50 and the tray. The moving elements can include low-friction material, having reduced sliding friction with the rails 50, wheels, or similar. In the present embodiment, the moveable tray 40 has four wheels 44 under its base 41 for moving along the rails 50, the wheels being made of a material with low friction with the rails 50, such as plastic.

The moveable tray 40 has a bumper 43 at a front end thereof to prevent a vendible product 11 from slipping off the front of the moveable tray 40. Additionally, the bumper 43 provides pushing assistance for stabilizing each moveable tray in a queue of moveable trays on the rail 50.

As seen in FIG. 6, the base 41 has a magnet attachable portion 45 at the bottom for coupling with a magnet on the dispensing unit 70, as discussed in greater detail below. The magnet attachable portion 45 can be made of magnetic materials such as steel. In embodiments in which the coupling with the dispensing unit 70 is achieved by means other than magnetic coupling, other mechanical means for coupling with the dispensing unit are contemplated.

As shown in FIGS. 5 and 6, the stand 42 is slotted into a slot, or rails, at a juncture, allowing the stand 42 to slide forward and backward along a length of the moveable tray 40 to adjust the space on the moveable tray 40 available to accommodate a vendible product 11. In the present embodiment, the stand 42 can be slid back and forth on stand slot 42B for this purpose. In some embodiments, the angle of the stand 42 is adjustable. The stand 42 is thereby movable to the required angles and distances for displaying a vendible product 11 effectively, and for adjusting the space provided by the moveable tray 40 to suit a particular product size.

Figure 7:
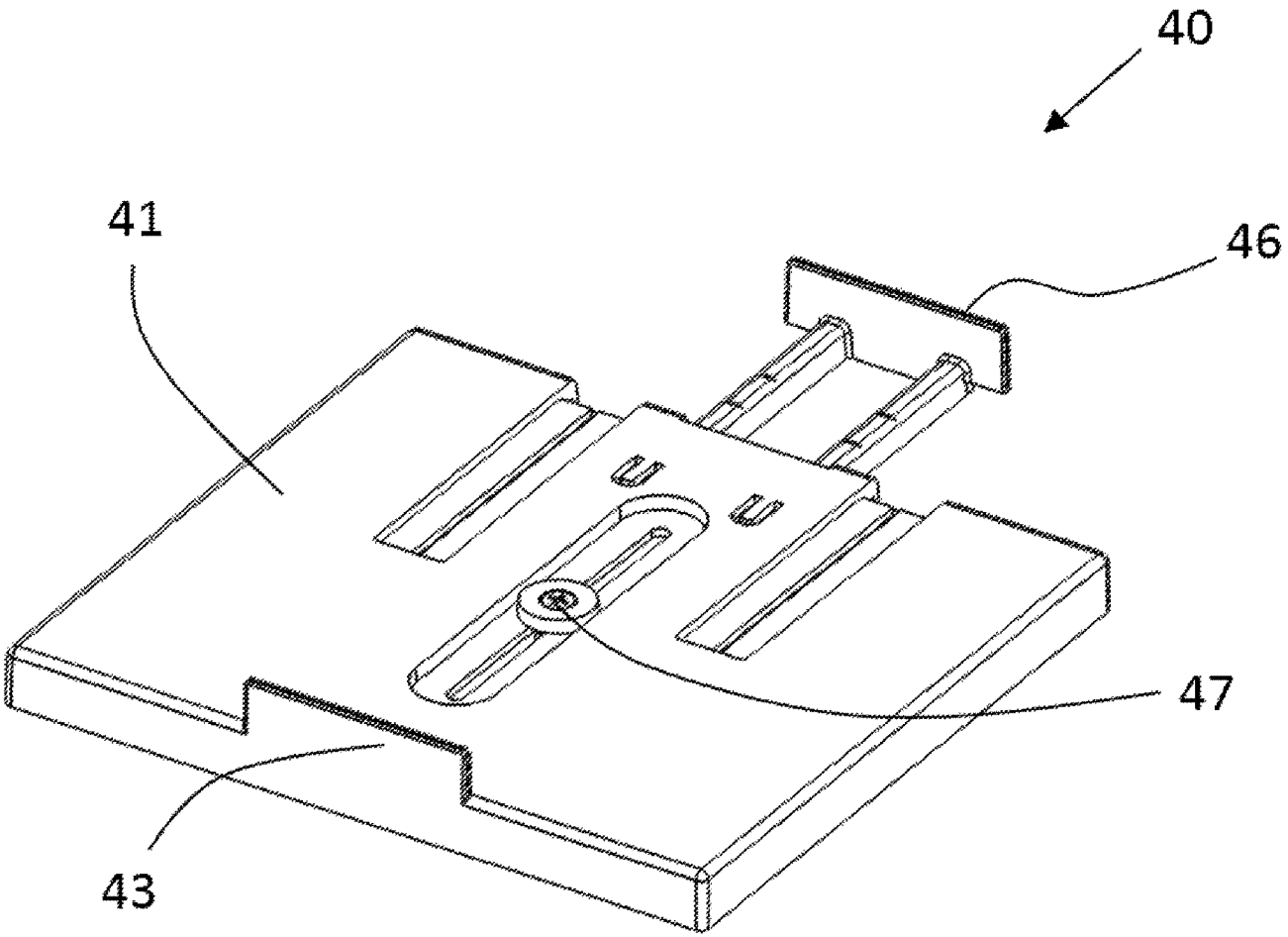
FIG. 7 is a perspective view of the moveable tray with a detachable stand removed.

As shown in FIG. 7, the stand 42 is detachable from the base 41 to provide additional space for an oversized vendible product 11, if required. In some embodiments, the base 41 includes a base-retaining magnet 47, which can magnetically couple with a magnetic portion of the vendible product 11 or its packaging, such as a magnetic sticker, to securely and releasably hold the vendible product 11 in place. The base-retaining magnet 47 is slidably attached to the base 41 so that the position of the base-retaining magnet 47 can be positioned to couple with the magnetic portion of the vendible product 11.

When the stand 42 is detached, a rear stopper 46 can be extendable to support the vendible product 11 from the rear. When the vendible product 11 is tall or thick, such as a laptop computer, large toy, or other large item, the rear stopper 46 is extended.

Figure 8:
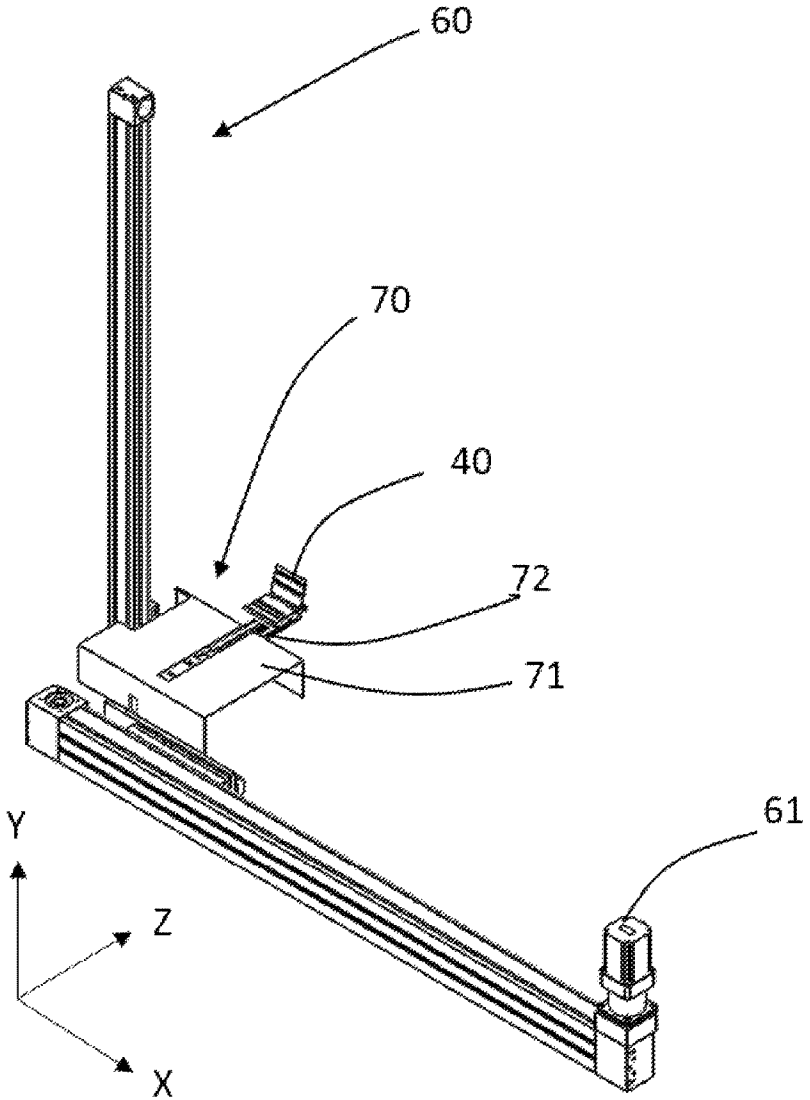
FIG. 8 is a perspective view of a gantry system with a dispensing unit.

Referring now to FIG. 8, a gantry system 60 is described. Gantry system 60 is capable of moving a dispensing unit 70 in the X (horizontal) and Y (vertical) directions using motors 61. In the present embodiment, the gantry system 60 moves along toothed belt axes allowing accurate movements of the gantry within a margin of error of about ±0.1 mm. Other means of moving the gantry system 60 are contemplated. In the present embodiment, the gantry system 60 can move in the X and Y directions simultaneously so as to move about the main product display area 10A, and the control area 10B, quickly.

The dispensing unit 70 is designed to lift a moveable tray 40 from a shelf 30, and, along with gantry system 60, move the moveable tray 40 to its destination, as in the methods for vending, returning, and restocking products, as outlined in greater detail below. The dispensing unit 70 generally comprises a picker 72 and a stage 71. The picker 72 comprises several components which, working together, can extend in the Z direction to couple with a tray 40, and retract to bring the tray 40 over the stage 71. The stage 71 provides a degree of safety and protect the vendible product 11 and moveable tray 40 as they are moved about the automated vending machine 10.

To facilitate with alignment of the picker 72 with a moveable tray 40, the bumper 43 on a moveable tray 40 can be marked, and the dispensing unit 70 can comprise optical sensors for aligning with the mark.

Figure 9:
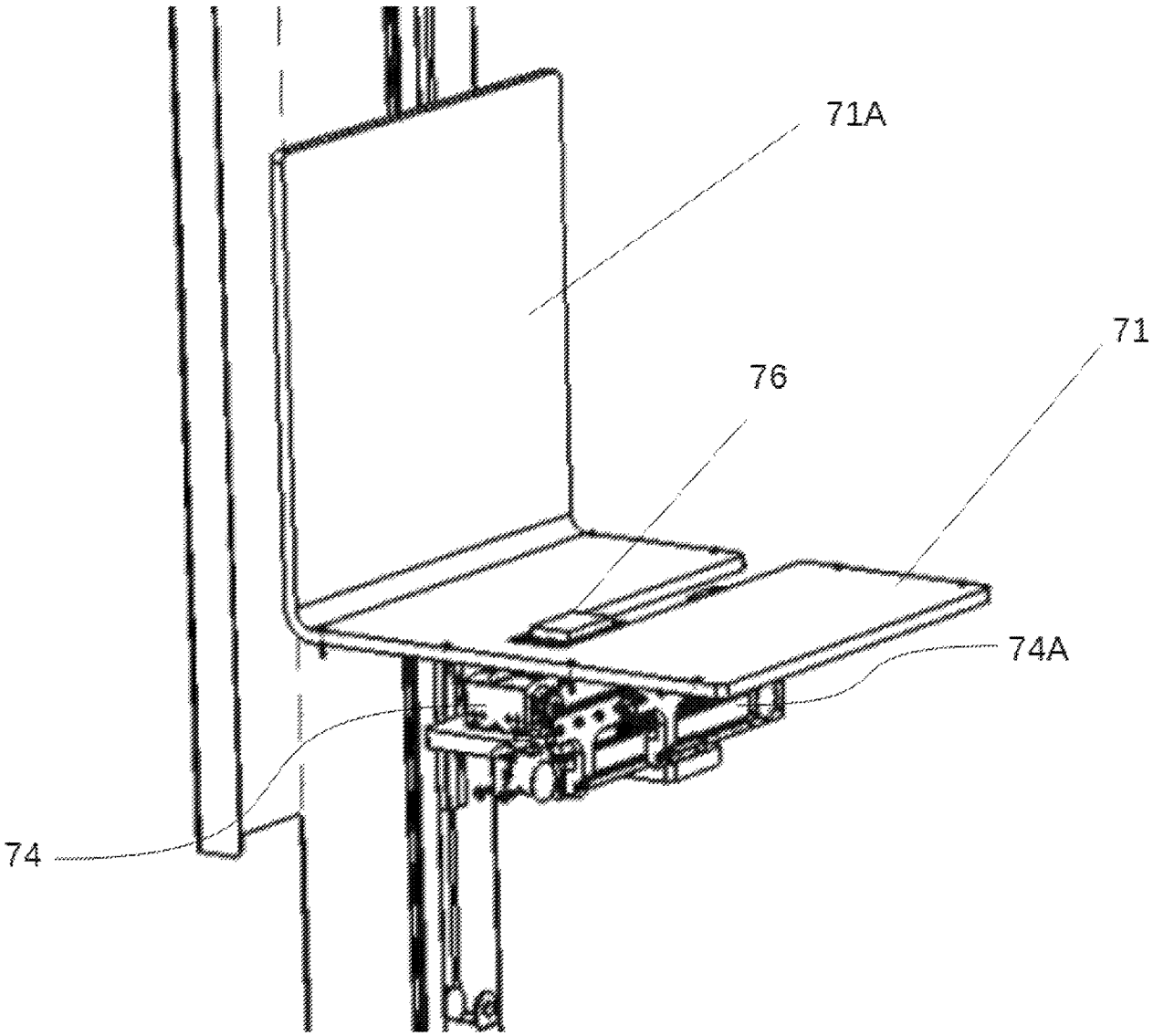
FIG. 9 is a perspective view of the dispensing unit with a blocking wall.

In some embodiments, the dispensing unit 70 can include at least one blocking wall as shown in FIG. 9, such as acrylic wall 71A, for preventing a customer from reaching past the dispensing unit 70 when it is in the dispensing zone 28. In some embodiments, the acrylic wall 71A can be configured to emit LED light for illuminating the area. In other embodiments, the blocking wall can comprise a wall of hard transparent plastic, plastic or metal fencing, or similar. The stage 71 can also include lighting fixtures for illuminating the selected vendible product 11 effectively. For example, a light guide stage including LEDs can illuminate the product from an appropriate direction.

Figure 10:
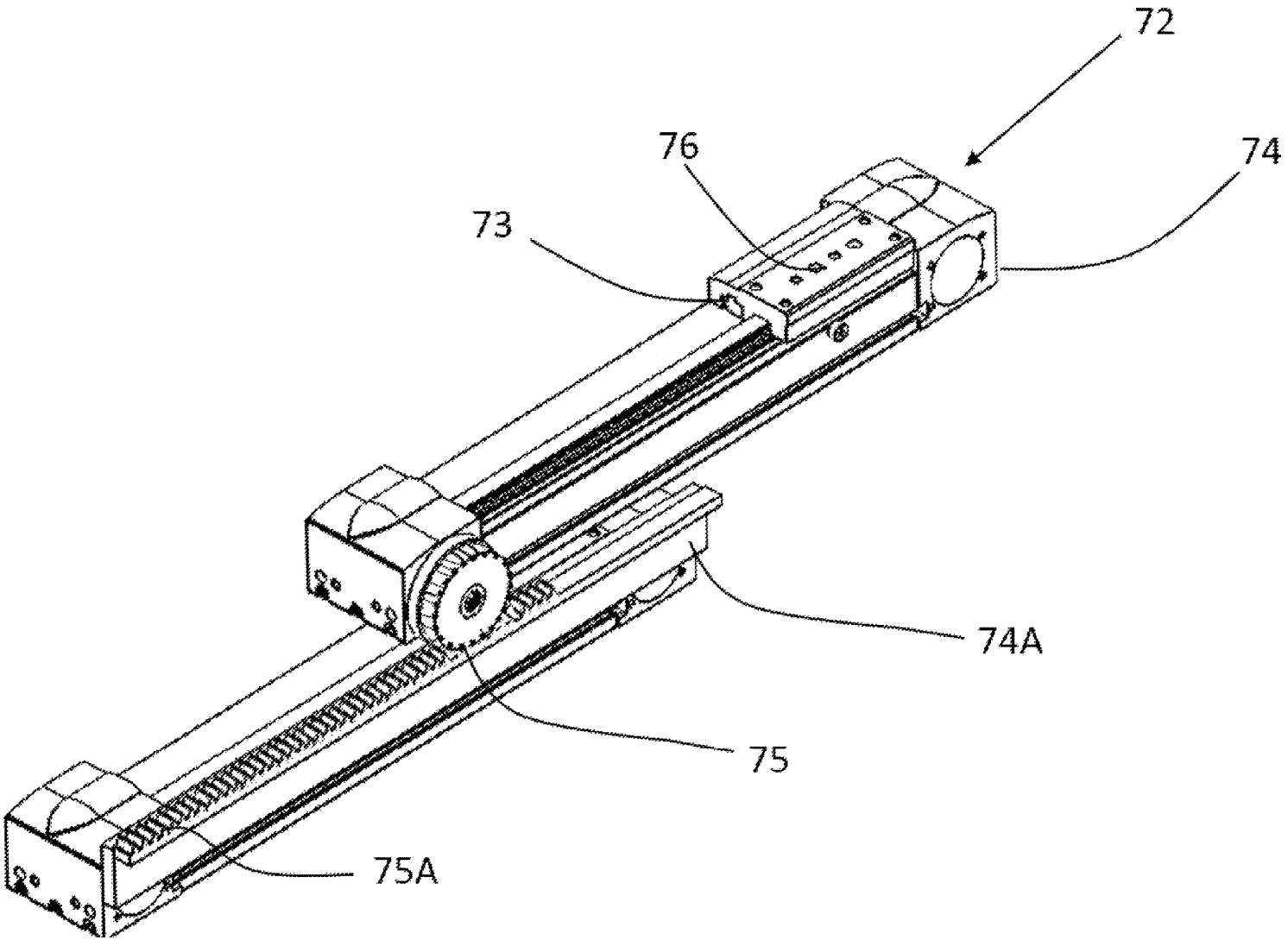
FIG. 10 is a perspective view of the dispensing unit, with support stage omitted.
Figure 11:
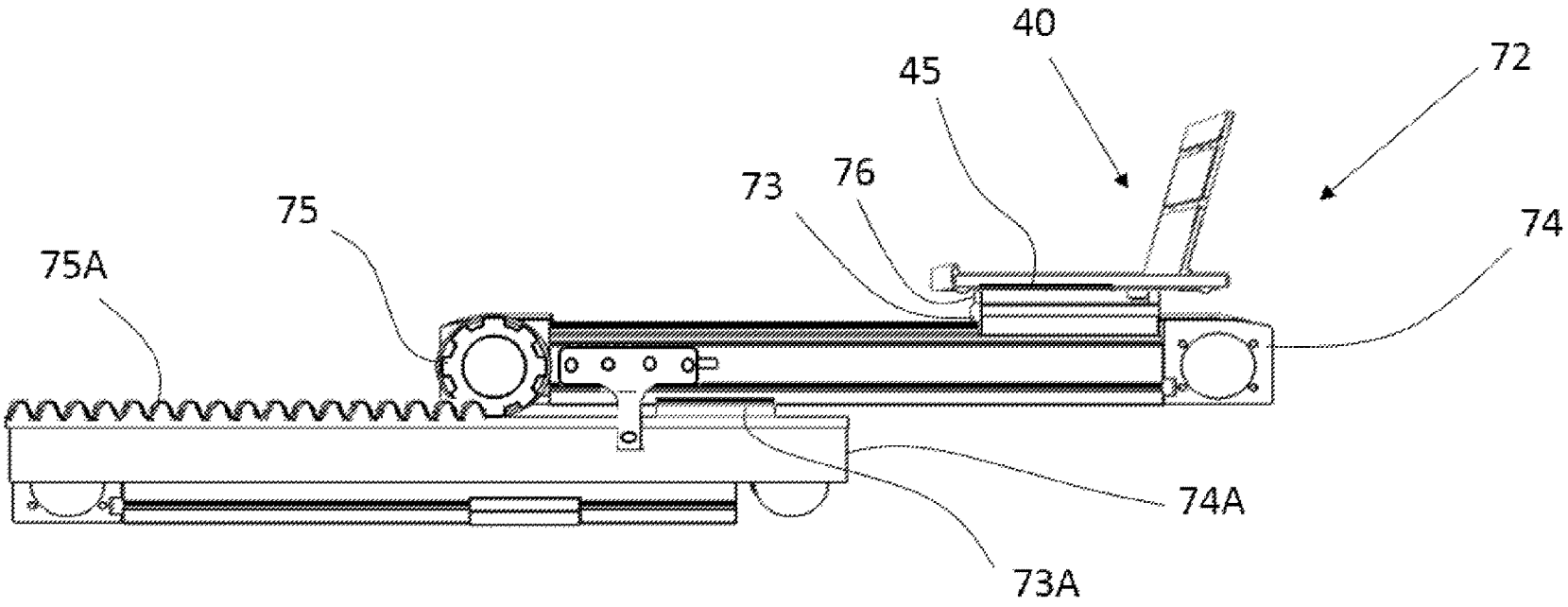
FIG. 11 is a side view of the dispensing unit, with support stage omitted.

Referring now to FIGS. 10-11, the picker 72 is described in greater detail. The picker 72 is the extending portion of the dispensing unit 70 which engages with a selected moveable tray 40 when the moveable tray 40 is selected for retrieval. The picker 72 comprises a lower linear axis 74A, an extending arm 74, and a slider 73.

The extending arm 74 travels along the lower linear axis 74A by means of a toothed rack 75A and pinion drive 75. In the present embodiment, the extending arm 74 is capable of travelling at a speed of about 50 mm/s with a repetition accuracy of about ±0.08 mm.

The slider 73 is linearly actuatable with respect to extending arm 74. In the present embodiment, the slider 73 is coupled, through a belt drive, with a lower slider 73A in mechanical communication between the lower linear axis 74A and the extending arm 74, allowing the slider 73 to slide along the extending arm 74 as the extending arm 74 travels along the lower linear axis 74A.

In other embodiments, other configurations of the picker 72 are contemplated in which the picker 72 can extend from the dispensing unit 70 to couple with a moveable tray 40.

FIG. 11 shows the picker 72 coupled with a moveable tray 40. In operation, the extending arm 74 and slider 73 move forward in the Z axis toward a selected moveable tray 40 for coupling. A coupling mechanism on slider 73 engages with the moveable tray 40. In the present embodiment, the coupling mechanism of the slider 73 comprises a magnetic portion 76, and the moveable tray 40 comprises a magnet attachable portion 45 on its base 41. In the present embodiment, the magnetic portion 76 can comprise a permanent magnet.

In some embodiments, the magnetic portion 76 can comprise an electromagnet. In such embodiments, the magnetic portion 76 can be alternately magnetized and unmagnetized as required for alternately retaining and releasing the dispensing unit 70 from the tray 40.

In other embodiments, the coupling mechanism can be a mechanical attachment for mechanically engaging with the base 41 of the moveable tray 40.

Figure 12:
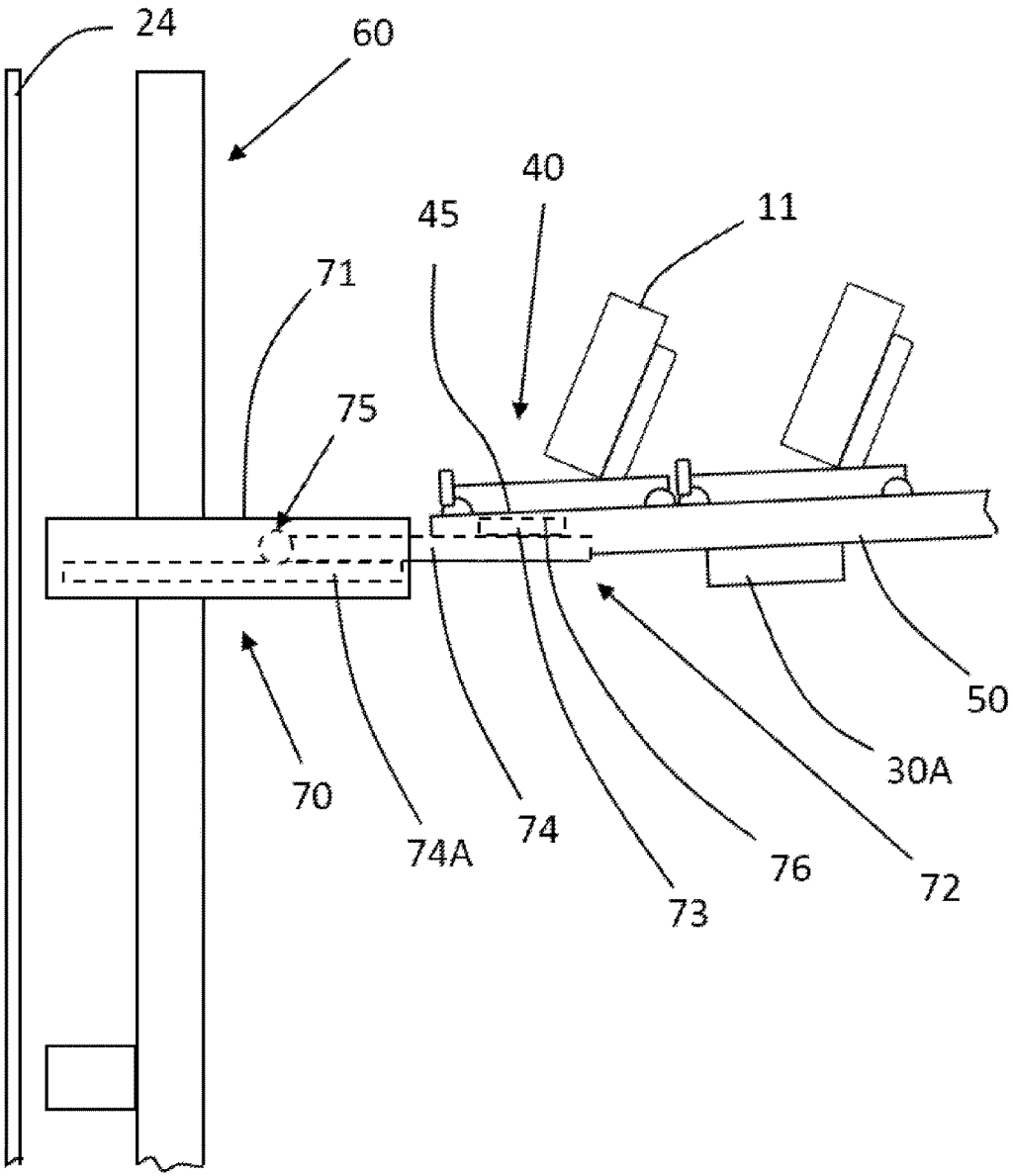
FIG. 12 is a side view of the gantry system, dispensing unit, and shelving system, with the dispensing unit coupling with a moveable tray on the shelving system.

FIG. 12 is a side profile view of the dispensing unit 70 in operation retrieving a selected moveable tray 40 from a support shelf 30. The dispensing unit 70 is shown in position in front of a front shelf 30A and aligned with a selected moveable tray 40 for retrieval. The extending arm 74 is shown extended across the lower linear axis 74A by the pinion drive 75. The slider 73 is shown situated underneath the selected moveable tray 40, with the magnet portion 76 magnetically coupling with the magnet attachable portion 45 of the selected moveable tray 40.

The depth of motion of the extending arm 74 and the slider 73 can vary depending on the size of the moveable tray 40 being retrieved. For example, where the moveable tray 40 is large, the slider 73 will extend further in the Z direction (see FIG. 8) because the magnet attachable portion 45 of the tray is situated further away from the dispensing unit 70.

After coupling with the selected moveable tray 40, the slider 73 and extending arm 74 can retract under the stage 71 of the dispensing unit 70, situating the selected moveable tray 40 over the stage 71, for transporting. Since the support shelf 30 and the rail 50 situated thereon are declined toward the front of the automated vending machine 10, the next moveable tray in the queue is gravity fed toward the front of the front support shelf 30A.

In some embodiments, the slider 73 can include contact (e.g., mechanical switches) or non-contact (e.g., optical devices) sensors to verify whether it has coupled with the selected moveable tray 40.

After the selected moveable tray 40 (and in some instances, with its vendible product 11) is settled over the stage 71, the gantry system 60 moves the dispensing unit 70 with the selected moveable tray 40 to the appropriate destination. During a vending process, as discussed in greater detail below, the moveable tray 40 is transported to the dispensing zone 28 (see FIG. 1) to be received by a customer.

When a customer picks up the vendible product 11 off the moveable tray 40 in the dispensing zone 28, the moveable tray 40 is left by the customer in the dispensing zone 28. The moveable tray 40 is subsequently removed from the dispensing zone 28 by the gantry system 60.

During a vending process, after the vendible product 11 has been removed by the customer, the gantry system may move the moveable tray 40 to a used tray bin 29A for storage. In some embodiments, the used tray bin 29A can be monitored by cameras installed inside the automated vending machine 10 to monitor the disposal of trays in the used tray bin 29A.

In some embodiments, access to the dispensing zone 28 can be limited to the customer by a dispensing zone hatch, which can alternately open and close access to the dispensing zone 28 as required. In such embodiments, the dispensing zone 28 can include electrical sensors or optical sensors to control opening speed of the dispensing zone hatch for a customers' safety.

In some embodiments, the dispensing zone 28 can also include sensors or cameras to identify whether a vendible product 11 is present in the dispensing zone 28, or whether it has been removed from the dispensing zone 28 by the customer. The dispensing zone 28 can also include lighting fixtures to illuminate the area and draw the attention of the customer.

Figure 13:
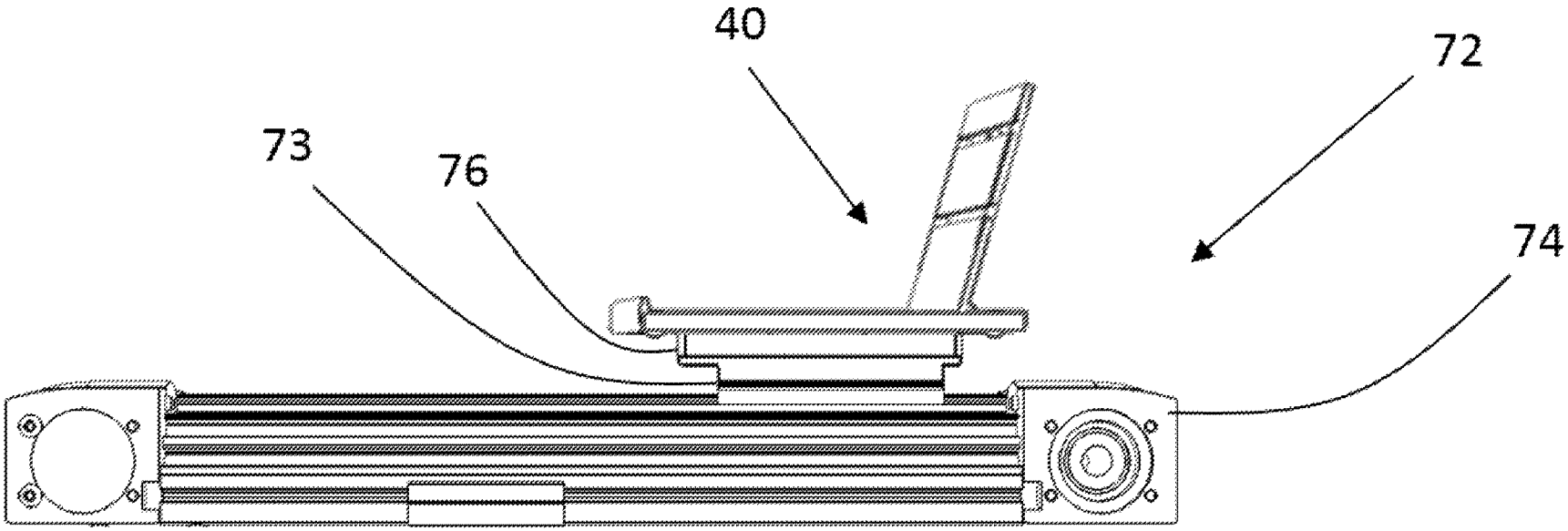
FIG. 13 is a side view of an alternative dispensing unit.

Other embodiments of the picker 72 are contemplated. In the present embodiment, the picker 72 operates using a linear actuator mechanism, involving the extending arm 74, the slider 73, and the lower linear axis 74A. This combination is suitable for reaching relatively long distances, such as for coupling with large trays. In other embodiments, however, where only small trays are used, the picker 72 may operate without a lower linear axis 74A. In such embodiments, the extending arm 74 can be fixed to the dispensing unit 70, protruding forward somewhat from the stage 71, allowing the slider 73, for coupling with a small moveable tray 40 on the shelf 30. Such an embodiment is exemplified in FIG. 13.

Figure 14:
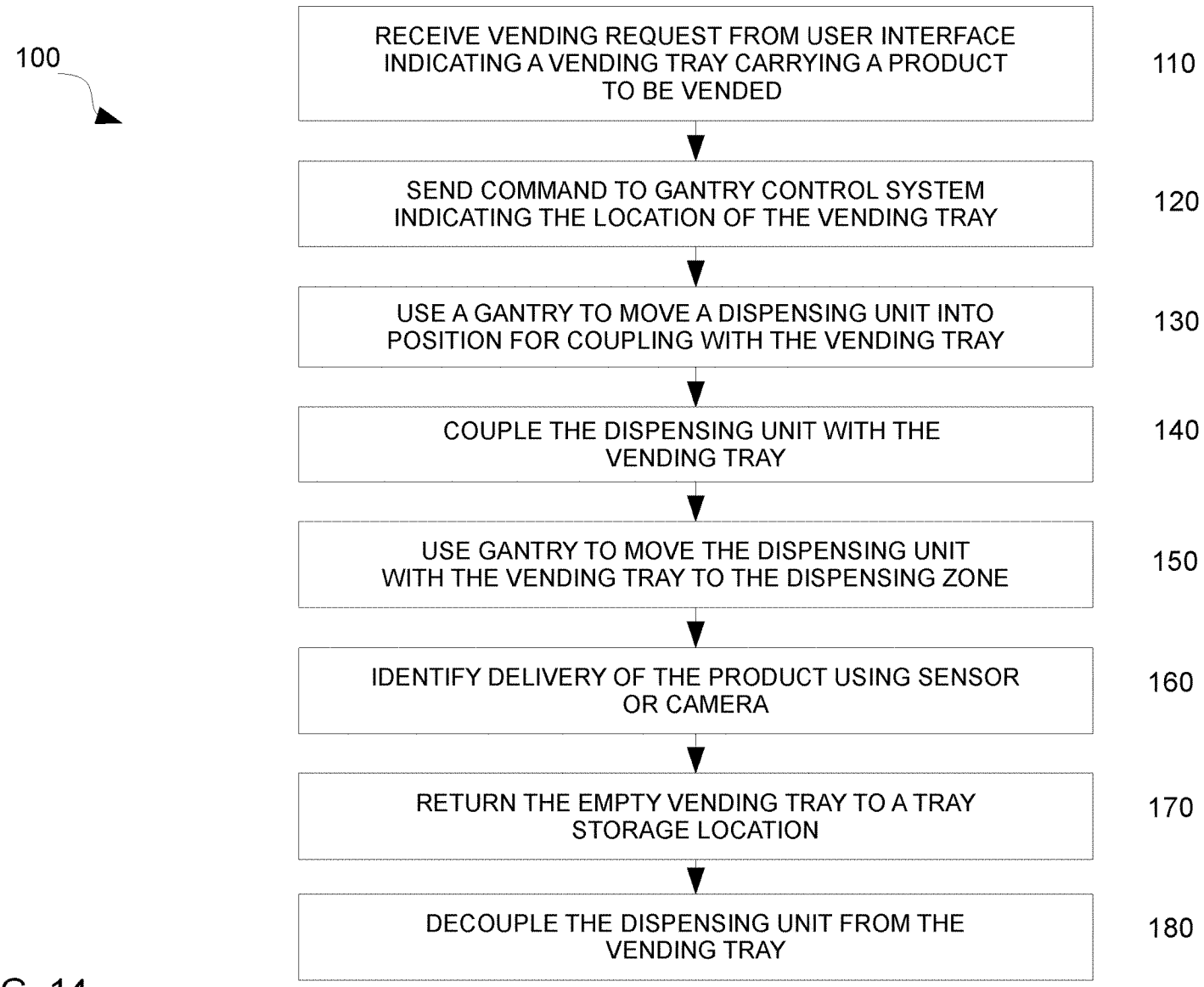
FIG. 14 is a flowchart illustrating a method of operating an automated vending machine for vending a vendible product.

Referring to FIG. 14, an exemplary method 100 of operating an automated vending machine for vending a product is disclosed. The method 100 is described as performed by a system described herein, but this is not limiting and the method can alternatively be performed by other systems.

At step 110, a vending request is received by control system 25 indicating a selected moveable tray 40 carrying a product to be vended (a "vending tray"). In one embodiment, the vending request is input by a customer through a user interface device 26 and payment module 27. In other embodiments, the vending request can be received via a telecommunications network in communication with the control system 25. The control system 25 stores a mapping of products and their tray locations (X, Y coordinates) and selects an appropriate tray based on the product selected by the customer.

At step 120, a command is sent to the gantry system 60 indicating the location of the selected vending tray 40, to move the dispensing unit 70 in position for coupling with the vending tray 40. In the present embodiment, the location of the vending tray 40 is stored in memory of control system 25 and the tray 40 is mapped to the product carried. In other embodiments, the location of vending tray 40 is stored in memory of a cloud system in communication with the control system 25. In the present embodiment, the vending tray 40 is stored on a support shelf 30 in the main product display area 10A.

At step 130, a gantry system 60 is used to move the dispensing unit 70 into the appropriate X, Y position (see FIG. 8) for coupling with the vending tray 40.

At step 140, the dispensing unit 70 couples with the vending tray 40. In the present embodiment, the dispensing unit 70 is coupled with the vending tray 40 by the following action. The dispensing unit 70 moves slightly downward in the Y direction (see FIG. 8), the extending arm 74 extend forward in the Z direction, and the slider 73 slides forward in the Z direction to be positioned underneath the vending tray 40. Once positioned, the dispensing unit 70 moves upward in the Y direction to couple the magnetic portion 76 of the slider 73 to the magnetic attachable portion 45 of the vending tray 40. In other embodiments, this coupling can be achieved by mechanical coupling. Once the vending tray 40 and slider 73 are coupled, the extending arm 74 and the slider 73 retract backward in the Z direction to bring the vending tray 40 over the stage 71 of the dispensing unit 70. In some embodiments, at this step, sensors of the dispensing unit 70 can detect whether the tray 40 and the product 11 are securely positioned on the dispensing unit 70.

At step 150, the gantry system 60 is used to move the dispensing unit 70 with the coupled vending tray 40 to the X, Y coordinates of the dispensing zone 28. While in the dispensing zone 28, the vendible product 11 is accessible to a customer. When a customer retrieves the delivered vendible product 11, the vending tray 40 is left behind within the dispensing zone 28, still coupled with the slider 73.

It is optional at this point, in step 160, for sensors or cameras on the dispensing unit 70 or in the dispensing zone 28 to detect whether the vendible product 11 was successfully delivered to the customer. If the vendible product 11 remains after a predetermined length of time, the automated vending machine 10 can issue a reminder the customer to retrieve the vendible product 11, by use of lighting fixtures on the dispensing unit 70 or in the dispensing zone 28, or through the use of speakers, or the user interface device 26.

At step 170, the vending tray 40, having delivered its vendible product 11, is moved by the gantry system 60 to the X, Y coordinates of a tray storage location, such as the used tray bin 29A or a support shelf in supplementary storage area 29B.

At step 180, the dispensing unit 70 is then decoupled from the vending tray 40. Cameras or sensors in the used tray bin 29A may detect whether the vending tray 40 has been received, or whether the used tray bin 29A is full.

Figure 15:
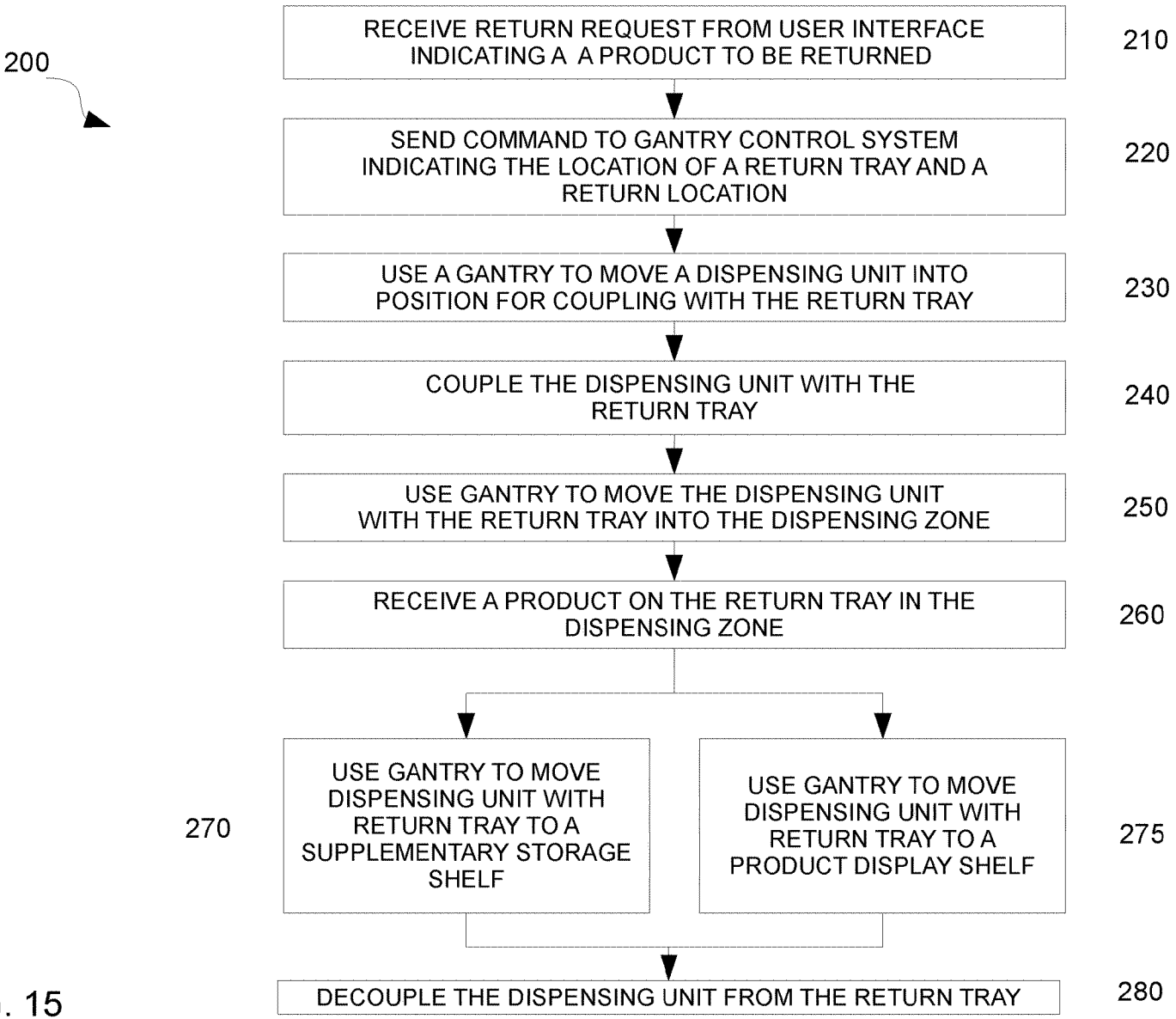
FIG. 15 is a flowchart illustrating a method of operating an automated vending machine for returning a vendible product.

FIG. 15 shows an exemplary method 200 of operating an automated vending machine for returning a vendible product. The method 200 is described as performed by a system described herein, but this is not limiting and the method can alternatively be performed by other systems.

At step 210, a return request is received by control system 25 indicating a vendible product 11 to be returned. In the present embodiment, the return request is input by a customer through a user interface device 26 and payment module 27. The control system 25 selects an appropriately sized and configured moveable tray 40 ("return tray") for receiving the specific product 11 being returned.

At step 220, a command is sent to the gantry system 60, indicating the X, Y coordinates (see FIG. 8) of the location of the return tray 40 and X, Y coordinates of a return location for returning the return tray 40. The command triggers the movement of the dispensing unit 70 into position for coupling with the return tray 40. In the present embodiment, the location of the return tray 40 and the return location are stored in the memory of the control system 25. In other embodiments, these locations are stored in memory of a cloud system in communication with the control system 25. The location of the return tray 40 may be at a support shelf 30 in supplementary storage area 29B awaiting use. The return location may be an empty location on a support shelf 30 in the supplementary storage area 29B, or may be an empty location on the support shelf 30 in the main product display area 10A.

At step 230, a gantry system 60 is used to move the dispensing unit 70 into position for coupling with the return tray 40.

At step 240, the dispensing unit 70 couples with the return tray 40. In the present embodiment, the dispensing unit 70 is coupled with the return tray 40 by the same action as described at step 140 in FIG. 14.

At step 250, the gantry system 60 is used to move the dispensing unit 70 with the coupled return tray 40 into the dispensing zone 28. The dispensing zone 28 is opened to the customer to return the vendible product 11.

At step 260, the vendible product 11 is received on the return tray 40 coupled with the dispensing unit 70 in the dispensing zone 28. The product 11 can be magnetically coupled to the return tray 40 by a retaining magnet 42A or a base-retaining magnet 47 so that the vendible product 11 and the tray 40 can be securely transported within the automated vending machine 10. In some embodiments, sensors or cameras on the dispensing unit 70 or in the dispensing zone 28 can identify the vendible product 11 before proceeding to the next step. In other embodiments, the identity of the vendible product 11 can be verified at a later point in time by, for example, visual verification, prior to the customer being refunded/credited for returning vendible product 11. Refunding or crediting the customer for the return can be withheld until an inspection of the returned product is performed. In this regard, the control system 25 can issue a notification via a network to an operator of the machine to indicate that a product has been returned and that manual collection and inspection of the returned product should be scheduled. In some embodiments, the identity of the returned product can be verified by a camera or other optical sensor in the dispensing zone 28, or in the supplementary storage area 29B.

After step 260, depending on where the return location is, either step 270 or step 275 is performed. In embodiments in which the identity of the product being returned cannot be readily verified, the return location is preferably an empty tray location in the supplementary storage area 29B, where the product being returned can be inspected before further use. In embodiments in which the identity of the product being returned can be readily verified, whether by cameras or optical sensors, the return location can be an empty tray location in the main product display area 10A.

At step 270, gantry system 60 is used to move the dispensing unit 70 with the coupled return tray 40 to a support shelf 30 in the supplementary storage area 29B. Alternatively, at step 275, gantry system 60 is used to move the dispensing unit 70 with the coupled return tray 40 to a support shelf 30 in the main product display area 10A.

At step 280, the dispensing unit 70 is decoupled from the return tray 40. In the present embodiment, the dispensing unit 70 is decoupled from the return tray 40 by the following action. The dispensing unit 70 moves slightly down in the Y direction, and the extending arm 74 and the slider 73 retract backward in the Z direction, releasing the return tray 40 onto the support shelf 30.

Figure 16:
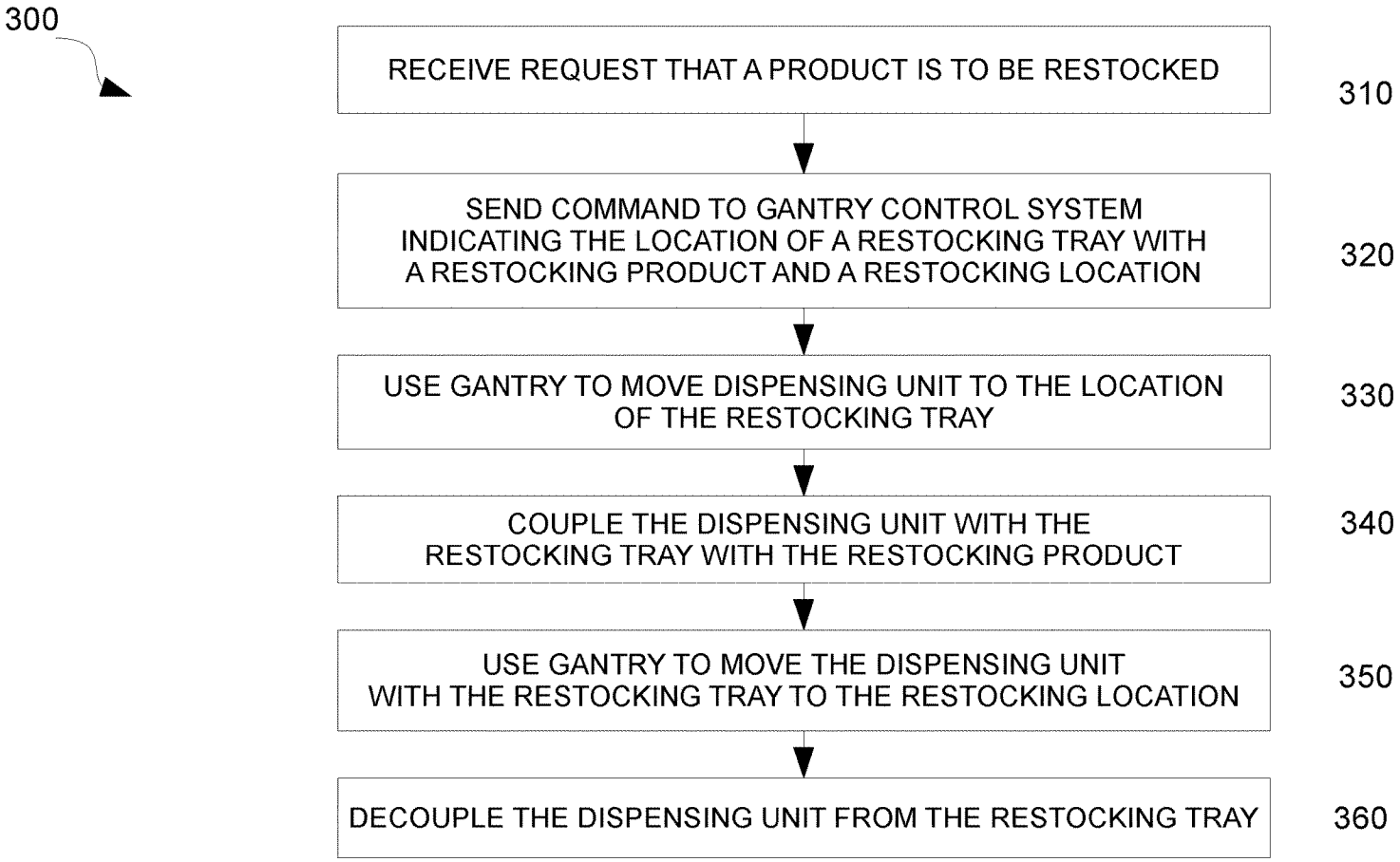
FIG. 16 is a flowchart illustrating a method of operating an automated vending machine for restocking a vendible product.

FIG. 16 shows an exemplary method 300 of operating an automated vending machine for restocking a vendible product. The method 300 is described as performed by a system described herein, but this is not limiting and the method can alternatively be performed by other systems.

At step 310, a restocking request is received by control system 25 indicating a vendible product 11 to be restocked, and a selected moveable tray 40 for transporting the vendible product 11 to be restocked (a "restocking tray"), with the restocking tray carrying the vendible product 11. In the present embodiment, the restocking request is generated at the control system 25 based on recognition that the vendible product 11 is out of stock. In other embodiments, the restocking request can be received by control system 25 from a cloud system in communication with the control system 25.

At step 320, a command is sent to the gantry system 60 indicating the X, Y coordinates of the location of the restocking tray 40 and the X, Y coordinates of the restocking location for the vendible product 11 to be restocked. The command triggers the movement of the dispensing unit 70 into position for coupling with the restocking tray 40. In the present embodiment, the location of the restocking tray 40 is stored in memory of control system 25. In other embodiments, the location of restocking tray 40 is stored in memory of a cloud system in communication with the control system 25. The restocking tray 40 with the vendible product 11 may be stored on a shelf 30 in the supplementary storage area 29B awaiting use.

At step 330, a gantry system 60 is used to move the dispensing unit 70 into position for coupling with the restocking tray 40.

At step 340, the dispensing unit 70 couples with the restocking tray 40. In the present embodiment, the dispensing unit 70 is coupled with the restocking tray 40 by the same action as described at step 140 in FIG. 14.

At step 350, the gantry system 60 is used to move the dispensing unit 70 with the coupled restocking tray 40 to the restocking location at a support shelf 30 in the main product display area 10A.

At step 360, the dispensing unit 70 is decoupled from the restocking tray 40. In the present embodiment, the dispensing unit 70 is decoupled from the restocking tray 40 by the same action as described at step 280 in FIG. 15.

It is contemplated that variations in the methods 100, and 200, and 300, may be employed. For example, the gantry system 60 may be sent the relevant locations (e.g. of the return tray or return location) at other times throughout the return process. For example, in method 200, the return location may be sent to the gantry system 60 only just prior to step 280 or 285. As another example, in method 100, a vending tray 40 can be returned to an empty location in the main product display area 10A.

More generally, other embodiments of the automated vending machine 10 are contemplated, including embodiments in which its major features, including the main product display area 10A, control area 10B, dispensing zone 28, and supplementary storage area 29B are rearranged. For example, the supplementary storage area 29B may be situated within the main product display area 10A, or the user interface device 26 may be further spaced away from the control system 25.

Thus, it can be seen that the present invention provides automated vending machine that can vend vendible products, accept returns of vendible products, and restock vendible products, the products being of various sizes and handling requirements, using a gantry system, moveable trays, and a gravity-fed modular shelving system. The shelving system can be readily manually arranged and requires minimal maintenance. A wide variety of different products can be handled in the same machine at the same time. That is, products of various sizes, weights, shapes, fragility, and display requirements can be readily sold from one machine. The automated vending machine further provides customers with an aesthetic and engaging experience.

The scope of the claims should not be limited by the embodiments set forth in the above examples, but should be given the broadest interpretation consistent with the description as a whole.

We claim:

1. An automated vending machine comprising:

a housing defining an interior, the interior having a dispensing zone accessible from an exterior of the automated vending machine;

a shelving system having wall racking, support shelves, and declined rails;

each support shelf of the support shelves and the wall racking configured with hook coupling mechanisms for facilitating manual releasable coupling of the support shelf to the wall racking, the wall racking for receiving and supporting each support shelf of the support shelves at desired heights;

each support shelf of the support shelves supporting a declined rail of the declined rails having a declivity from an upper end of the declined rail to a lower end of the declined rail and a stopper at the lower end;

a plurality of moveable trays disposed within the interior of the housing, each of the plurality of moveable trays riding on a respective declined rail of the declined rails, whereby each respective moveable tray is gravity fed toward the stopper at the lower end of the respective declined rail;

each moveable tray of the plurality of moveable trays configured to support a vendible product displayed thereon;

a dispensing unit having a coupling mechanism configured to releasably couple with a selected moveable tray of the plurality of moveable trays; and a gantry system configured to move the dispensing unit about the interior of the automated vending machine and the dispensing zone, and configured to position the coupling mechanism of the dispensing unit for releasably coupling and decoupling with the selected moveable tray.

2. The automated vending machine of claim 1 wherein the lower end of a declined rail of the declined rails extends in a protruding portion beyond a support shelf supporting the declined rail, the protruding portion of the declined rail defining a cutout for receiving the coupling mechanism of the dispensing unit from below the declined rail for raising a moveable tray off the declined rail.

3. The automated vending machine of claim 1 wherein the interior of the automated vending machine further comprises a supplementary storage shelving system for storing restocking products, each restocking product being supported on a moveable tray.

4. The automated vending machine of claim 1 wherein a moveable tray supporting a vendible product further comprises a retaining magnet for magnetically coupling with a magnetic portion of the vendible product.

5. The automated vending machine of claim 1 wherein the dispensing unit is configured to retract a coupled moveable tray over a support stage of the dispensing unit.

6. The automated vending machine of claim 1 wherein at least one of the declined rails comprises a pair of complimentary declined rails suitable for conforming to a base of a moveable tray by being spaced apart on a support shelf.

7. The automated vending machine of claim 1 wherein the coupling mechanism of the dispensing unit comprises a coupling magnet for releasably coupling with a magnetic portion of the selected moveable tray.

8. The automated vending machine of claim 7 wherein the coupling magnet of the coupling mechanism comprises an electromagnet.

9. A moveable tray for carrying a vendible product in an automated vending machine, the moveable tray comprising:

a base configured to be in slidable communication with a declined rail in the automated vending machine, the base having an attachable portion for receiving a coupling mechanism of a dispensing unit of the automated vending machine; and a detachable stand slotted into a slot in the base of the moveable tray at a juncture, the slot allowing slidable movement of the detachable stand across a length of the base, the juncture supporting the detachable stand for supporting a vendible product leaning upright against the detachable stand.

10. The moveable tray of claim 9 wherein the coupling mechanism of the dispensing unit comprises a coupling magnet, and wherein the attachable portion of the base comprises a magnetic portion for coupling with the coupling magnet.

11. The moveable tray of claim 9 wherein at least one of the base and the detachable stand further comprise a magnet for magnetically coupling with a magnetic portion of the vendible product.

12. A method of operating an automated vending machine, the method comprising:

receiving a movement request indicating a first location and a second location, the first location being occupied by a moveable tray, the second location being a destination suitable for being occupied by the moveable tray;

sending a command to a gantry system indicating the first location and the second location;

using the gantry system to move a dispensing unit into a position near the first location for coupling with the moveable tray;

coupling the dispensing unit with the moveable tray;

using the gantry system to move the dispensing unit with the moveable tray into a position near the second location for decoupling with the moveable tray at the second location; and decoupling the dispensing unit from the moveable tray.

13. The method of claim 12 wherein the movement request is a vending request, the moveable tray is carrying a vendible product for being vended, the first location is at a support shelf in a display area of the automated vending machine, and the second location is at a dispensing zone accessible from an exterior of the automated vending machine.

14. The method of claim 12 wherein the movement request is a restocking request, the moveable tray is carrying a vendible product for being restocked, the first location is at a support shelf in a supplementary storage area of the automated vending machine, and the second location is at a support shelf in a display area of the automated vending machine.

15. The method of claim 12 wherein the movement request is a product return request, the moveable tray is an empty moveable tray suitable for receiving a product being returned, the first location is at a support shelf in the automated vending machine for storing empty moveable trays, the second location is at a dispensing zone accessible from an exterior of the automated vending machine, and wherein the method further comprises, prior to the decoupling step:

receiving a product being returned on the moveable tray; and using the gantry system to move the dispensing unit with the moveable tray into a position near a third location for decoupling with the moveable tray at the third location, the third location being at a support shelf in a supplementary storage area of the automated vending machine.

16. The method of claim 12 wherein the movement request is a product return request, the moveable tray is an empty moveable tray suitable for receiving a product being returned, the first location is at a support shelf in the automated vending machine for storing empty moveable trays, the second location is at a dispensing zone accessible from an exterior of the automated vending machine, and wherein the method further comprises, prior to the decoupling step:

receiving a product being returned on the moveable tray; and using the gantry system to move the dispensing unit with the moveable tray into a position near a third location for decoupling with the moveable tray at the third location, the third location being at a support shelf in a display area of the automated vending machine.

17. The method of claim 15 further comprising, following the receiving step, verifying that the product being returned has been received on the moveable tray.

18. The method of claim 16 further comprising, following the receiving step, verifying that the product being returned has been received on the moveable tray.

19. The method of claim 12 wherein the coupling step comprises:

positioning a coupling mechanism of the dispensing unit below an attachable portion of a base of the moveable tray; and raising the coupling mechanism to couple with the attachable portion of the base of the moveable tray.

20. The method of claim 19 wherein the coupling mechanism of the dispensing unit comprises a coupling magnet, and wherein the attachable portion of the base of the moveable tray comprises a magnetic portion for coupling with the coupling magnet.

* * * * *